US006899003B1

(12) United States Patent
Yoshii

(10) Patent No.: US 6,899,003 B1
(45) Date of Patent: May 31, 2005

(54) ROTARY CUTTING MACHINE FOR CORRUGATED CARDBOARD PLATE

(75) Inventor: Hisato Yoshii, Okayama (JP)

(73) Assignee: Daizen Kabusiki Kaisha, Okayama (JP)

( * ) Notice: Subject to any disclaimer, the term of this patent is extended or adjusted under 35 U.S.C. 154(b) by 21 days.

(21) Appl. No.: 09/688,863

(22) Filed: Oct. 17, 2000

(30) Foreign Application Priority Data

Oct. 25, 1999 (JP) ..... 11-302708

(51) Int. Cl.[7] ..... B26D 7/01; B26D 1/24

(52) U.S. Cl. ..... 83/438; 83/431; 83/495; 83/578

(58) Field of Search ..... 83/885, 578, 495, 83/500, 431, 447, 438

(56) References Cited

U.S. PATENT DOCUMENTS 1,422,901 A * 7/1922 Terry ..... 83/500 X
1,435,252 A * 11/1922 Neal ..... 83/500 X
2,945,517 A * 7/1960 Sower et al. ..... 83/578 X
3,125,139 A * 3/1964 Weinierl ..... 83/495
3,762,249 A * 10/1973 Wheeler et al. ..... 83/495 X
4,614,138 A * 9/1986 Altman ..... 83/495 X
4,985,982 A * 1/1991 Lohr et al. ..... 83/500 X
5,165,314 A * 11/1992 Paulson et al. ..... 83/500 X
5,179,883 A * 1/1993 Payr ..... 83/578 X
5,287,782 A * 2/1994 Scott ..... 83/447
5,442,983 A * 8/1995 D'Angelo et al. ..... 83/578 X
5,937,723 A * 8/1999 Kirikoshi et al. ..... 83/578 X
6,092,452 A * 7/2000 Adami ..... 83/495 X
6,148,706 A * 11/2000 Witjes ..... 83/495

* cited by examiner

*Primary Examiner*—Charles Goodman
(74) *Attorney, Agent, or Firm*—Sughrue Mion, PLLC

(57) ABSTRACT

A cutting machine for cutting a flat cardboard plate 2 includes first and second rotary cutters 7 and 8 rotatable in respective directions counter to each other for cutting upper and lower portions of a thickness of the flat cardboard plate 2, respectively. The first and second rotary cutters 7 and 8 and the flat cardboard plate 2 are moved relative to each other in a direction conforming to a single cutting line b to cut the flat cardboard plate 2 along the cutting line b. In this way, the flat cardboard plate 2 having a relatively great thickness can be cut with high cutting accuracy.

14 Claims, 5 Drawing Sheets

ROTARY CUTTING MACHINE FOR CORRUGATED CARDBOARD PLATE

BACKGROUND OF THE INVENTION

1. Field of the Invention

The present invention generally relates to a rotary cutting machine and, more particularly, to the rotary cutting machine for cutting a flat cardboard plate made up of a plurality of laminated corrugated cardboards.

2. Description of the Prior Art

The rotary cutting machine of the kind referred to above is well known in the art. The known rotary cutting machine includes a support table on which a flat cardboard plate is intermittently transported in a direction longitudinally of the support table, and a rotary cutter having a cutting blade movable in a direction transverse to the support table, that is, in a direction widthwise of the flat cardboard plate for cutting the flat cardboard plate into a plurality of corrugated cardboard blocks of a predetermined length while the flat cardboard plate then transported along the support surface is held still. The cutting blade used in the rotary cutter in the known cutting machine generally in the form of a circular saw having a multiplicity of saw teeth that are alternately offset with respect to side faces of the circular saw.

In this known rotary cutting machine, it has been found that as the diameter of the rotary cutting blade increase, the saw teeth of the rotary cutting blade tend to deform considerably in a direction laterally of the plane of rotation of the rotary cutter. Thus, the use of the rotary cutting blade of a relatively great diameter results in not only reduction of the cutting accuracy expressed in terms of the kerf of a predetermined width, but also a rocking motion of the rotary cutter while the latter is rotating. This in turn results in increase of the kerf with a correspondingly large amount of chips consequently cut from the flat cardboard plate, accompanied by a consequent reduction of the yield of the corrugated cardboard blocks cut from the flat cardboard plate.

On the other hand, if the rotary cutting blade of a reduced diameter is employed in an attempt to eliminate the above discussed problems, the maximum thickness of the flat cardboard plate that can be cut is limited. By way of example, if the rotary cutter having the rotary cutting blade of 560 mm in diameter is disposed below the support table with an outer peripheral portion of the rotary cutting blade protruding upwardly from the support table for cutting the flat cardboard plate, the thickness of the support table becomes one of elements that limits the maximum thickness of the flat cardboard plate that can be cut and, therefore, a maximum of about 140 mm in thickness of the flat cardboard plate is available for cutting with the known rotary cutter. If the rotary cutter is disposed above the support table, the thickness of the support table does no longer constitute a cause of reduction of the maximum thickness of the flat cardboard plate that can be cut, but the maximum thickness of the flat cardboard plate that can be cut is still limited to about 170 mm.

SUMMARY OF THE INVENTION

In view of the foregoing, the present invention has been devised to substantially eliminate the above discussed problems inherent in the prior art rotary cutting machine and is intended to provide an improved rotary cutting machine capable of cutting the flat cardboard plate of a relatively large thickness with high cutting precision.

In order to accomplish the foregoing object of the present invention, there is provided a cutting machine for cutting a flat cardboard plate including a cardboard, which machine includes a first rotary cutter for cutting an upper portion of the flat cardboard plate, a second rotary cutter rotatable in a direction counter to a direction of rotation of the first rotary cutter for cutting a lower portion of the flat cardboard plate, a drive mechanism for driving the first and second rotary cutters relative to the flat cardboard plate along a single cutting line to cut the flat cardboard plate along such cutting line.

With the cutting machine of the structure in accordance with the present invention, since the cutting of the flat cardboard plate is carried out by the first rotary cutter for cutting the upper portion of the flat cardboard plate in cooperation with the second rotary cutter for cutting the lower portion of the flat cardboard plate, the flat cardboard plate can be satisfactorily cut with no need to increase the outer diameter of each of the first and second rotary cutters. Also, since the use of the first and second rotary cutters of a relatively reduced outer diameter is sufficient, any possible lateral deformation of the blade tip of each of the first and second rotary cutters can advantageously minimized, resulting in increase of the cutting accuracy and, on the other hand, since any possible rocking motion of any one of the first and second rotary cutters in a lateral direction is minimized, the kerf can be reduced to increase the yield.

In one preferred embodiment of the preset invention, each of the first and second rotary cutters rotates in such a direction as to permit a leading portion of the respective rotary cutter, with respect to a direction of movement by the drive mechanism relative to the flat cardboard plate, to plunge into the flat cardboard plate.

When the flat cardboard plate is cut by the rotary cutter, it may occur that burring may occur on a trailing side of the rotary cutter, in a direction of rotation, where the rotary cutter departs from the flat cardboard plate. However, with the cutting machine embodying the present invention, even though burring occurs during a cutting at a cut section of the flat cardboard plate as a result of cutting by any one of the first and second rotary cutters, such burring will occur at a portion of the flat cardboard plate intermediate of the thickness thereof and no burring will occur on front and rear side of the flat cardboard plate. Accordingly, the flat cardboard plate can be beautifully cut.

In another preferred embodiment of the present invention, the cutting machine of the type referred to above may further include a support table for supporting from below the flat cardboard plate, and a level adjusting mechanism for adjusting a relative position between the support table and the first and second rotary cutters in a direction up and down according to a thickness of the flat cardboard plate to be cut and for setting a boundary between respective depth of cutting by the first and second rotary cutters to a value substantially equal to one half of a thickness of the flat cardboard plate.

With the cutting machine of the structure described above, even where the flat cardboard plates of a varying thickness are to be cut one at a time, the level adjusting mechanism is effective to set the boundary between respective depth of cutting by the first and second rotary cutters to a value substantially equal to one half of a thickness of the flat cardboard plate and, therefore, the first and second rotary cutters of a reduced outer diameter are effective to beautifully cut the flat cardboard plates of a thickness ranging from a small value to a large value.

The level adjusting mechanism referred to above is preferably of a type capable of selectively elevating and lowering the support table.

In a further preferred embodiment of the present invention, the cutting machine may further include a support structure for rotatably supporting the first and second rotary cutters. In this case, the drive mechanism is operable to move the support structure relative to the flat cardboard plate.

In a yet further preferred embodiment of the present invention, the cutting machine may also include a support table for supporting from below the flat cardboard plate, and a retaining mechanism for pressing a portion of the flat cardboard plate on a trailing side of the cutting line with respect to a direction of feed of the flat cardboard plate against the support table to retain the flat cardboard plate immovable during a cutting operation, to thereby allow the flat cardboard plate to be accurately and stably cut.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
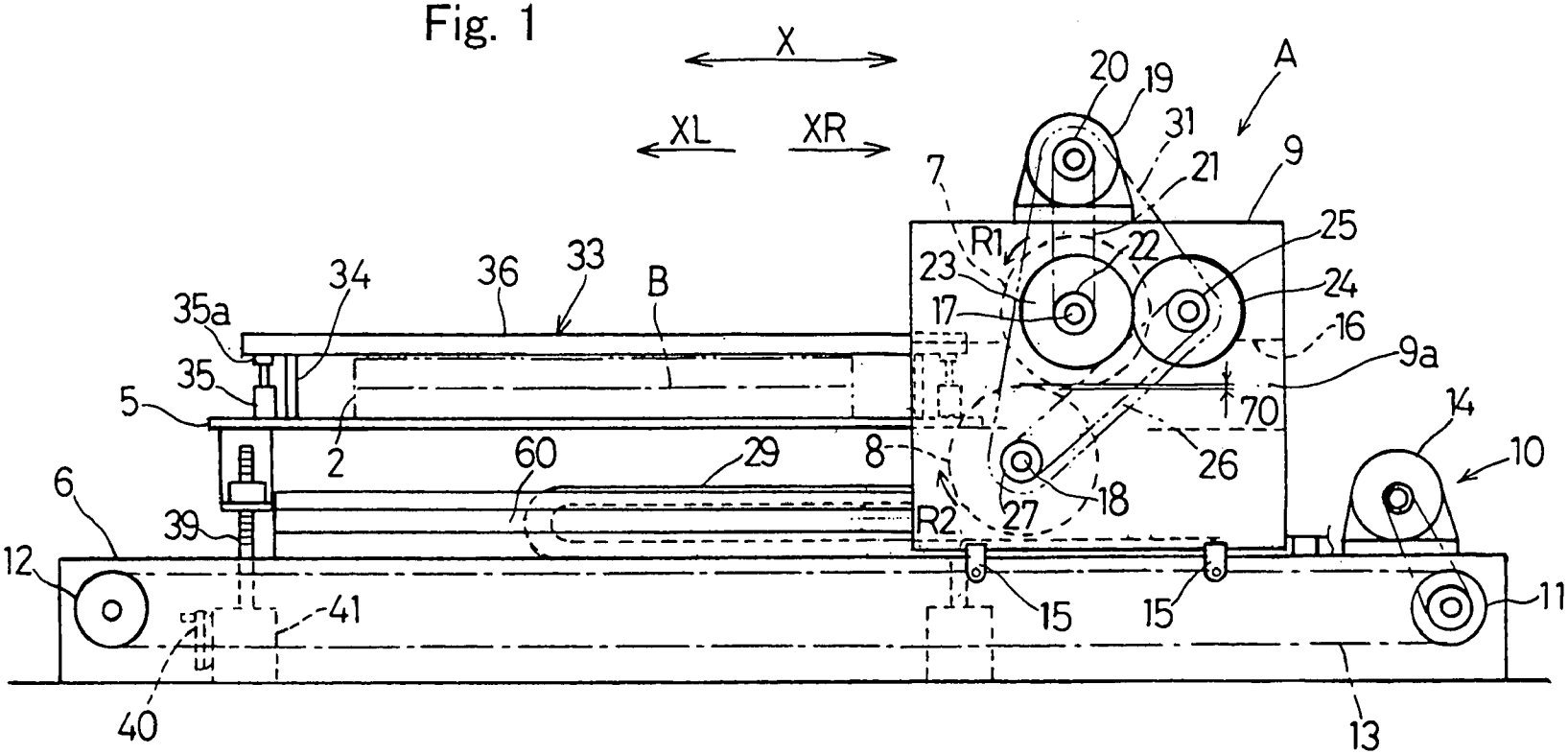
FIG. 1 is a longitudinal front elevational view of a rotary cutting machine according to a first preferred embodiment of the present invention.
Figure 2:
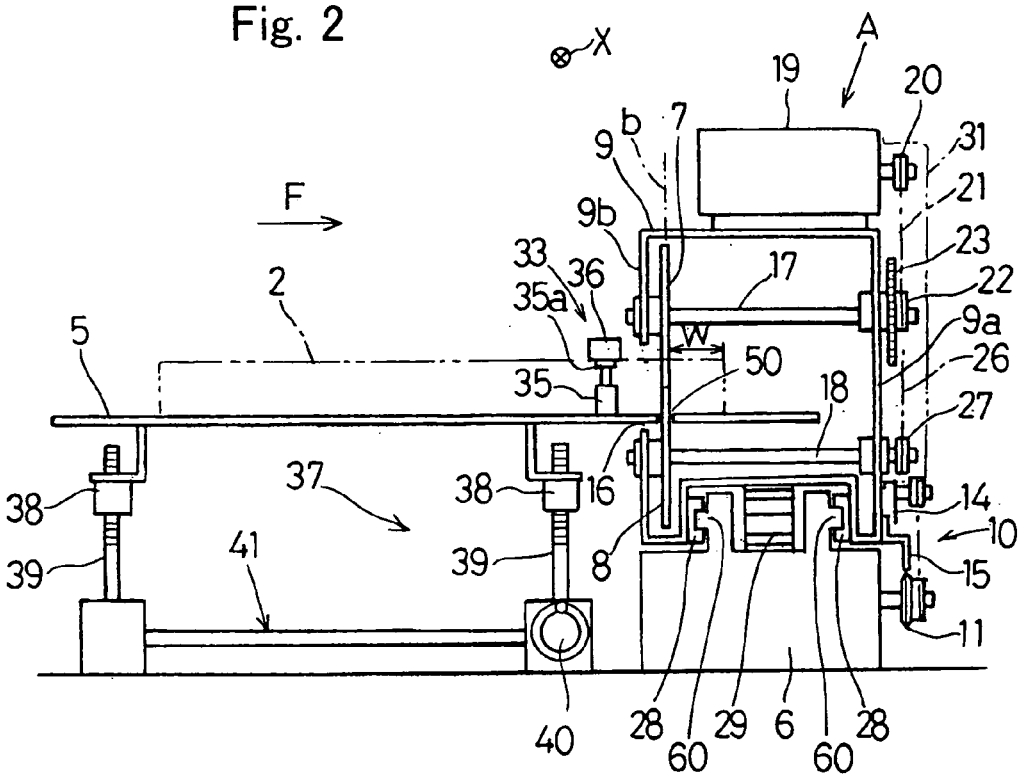
FIG. 2 is a left-side end view of the rotary cutting machine shown in FIG. 1.
Figure 3A:
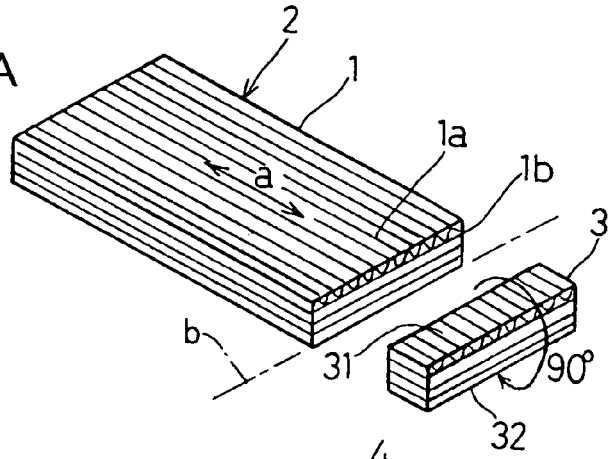
FIG. 3A is a perspective view showing the manner in which a flat cardboard plate is cut into a plurality of corrugated cardboard blocks.

FIG. 1 shows, in a longitudinal front elevational view, a rotary cutting machine A according to a first preferred embodiment of the present invention, and FIG. 2 is a left-side end view of the rotary cutting machine A. This rotary cutting machine A is used to cut, as shown in FIG. 3A, a flat cardboard plate 2 into a plurality of corrugated cardboard blocks 3. As best shown in FIG. 3A, the flat cardboard plate 2 with which the rotary cutting machine A of the present invention works is of a kind made up of a plurality of laminated corrugated cardboards 1 each including a corrugated core sheet 1*a* sandwiched between liner sheets 1*b*. The rotary cutting machine A of the present invention is used to cut such flat cardboard plate 2 along a cutting line b, which extends in a transverse direction perpendicular to the direction of ridges a of the corrugated core sheet 1*a* of each corrugated cardboard 1, so as to provide the corrugated cardboard blocks 3.

Figure 3B:
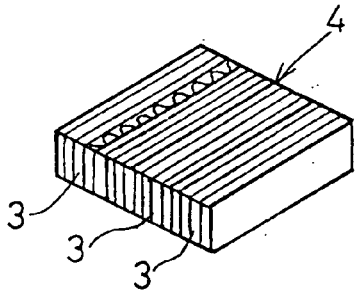
FIG. 3B is a perspective view showing an aggregation of the corrugated cardboard blocks cut from the flat cardboard plate.

The corrugated cardboard blocks 3 so cut from the flat cardboard plate 2 are turned 90° one at a time in a direction shown by the arrow in FIG. 3A and are then bonded together to provide a flat corrugated cardboard product 4 wherein top and bottom faces 31 and 32 of each corrugated cardboard block 3 with respect to the direction of lamination of the corrugated cardboards 1 in the flat cardboard plate 2 are bonded with the bottom and top faces 32 and 31 of the neighboring corrugated cardboard blocks 3, respectively, as shown in FIG. 3B. If desired or required, the flat corrugated cardboard product 4 so formed as shown in FIG. 3B may have its upper and lower surfaces lined with respective sheets of paper to complete a plate member. Accordingly, if burring occurs at the top and bottom faces 31 and 32 of each of the corrugated cardboard blocks 3 cut from the flat cardboard plate 2 as a result of cutting, a bonding defect will occur when the corrugated cardboard blocks 3 are bonded together to provide the flat corrugated cardboard product 4.

Referring particularly to FIG. 2, the rotary cutting machine A includes a support table 5 for supporting from below the flat cardboard plate 2 to be cut, and an guide bench 6 extending in a direction transverse to the direction F of feed of the flat cardboard plate 2 (and in a direction conforming to the leftward and rightward direction shown by the arrow X) and positioned at a location forward of the direction F of feed that lies perpendicular to the cutting line b. As shown in FIG. 1, a support structure 9 carrying first and second rotary cutters 7 and 8 is mounted on the guide bench 6 for movement in the leftward and rightward direction (the direction X) along the guide bench 6 between rest and advanced positions and is adapted to be driven by a drive mechanism 10 as will be described later. The first and second rotary cutters 7 and 8 are utilized to cut from above and below, respectively, the flat cardboard plate 2 resting on the support table 5 into the corrugated cardboard blocks 3 and, hence, to cut upper and lower halves of the thickness of the cardboard plate 2, respectively.

The drive mechanism 10 for driving the support structure 9 includes a generally endless chain 13 trained between and around sprockets 11 and 12 rotatably mounted on the guide bench 6, and a rotary drive motor 14 for driving the endless chain 13. The support structure 9 is drivingly connected with the endless chain 13 by means of one or more connecting members 15 fixed at one end to the support structure 9 and at the opposite end to a portion of the endless chain 13.

As shown in FIG. 2, the support structure 9 is in a generally rectangular channel form opening in the leftward and rightward direction X or in a direction conforming to the direction of movement thereof and includes front and rear walls 9*a* and 9*b*. The rear wall 9*b* of the support structure 9 is formed with a window 16 through which, when the support structure 9 is moved relatively in the leftward and rightward direction X towards the advanced position, a leading end portion of the flat cardboard plate 2 to be cut can pass. The first rotary cutter 7 positioned above the second rotary cutter 8 is fixedly mounted on a rotary shaft 17 that is journalled to the front and rear walls 9*a* and 9*b* of the support structure 9 and is so positioned that a lowermost outer peripheral portion of the first rotary cutter 7 can plunge from above into the flat cardboard plate 2 to a depth slightly greater than one half of the thickness of the flat cardboard plate 2. On the other hand, the second rotary cutter 8 positioned below the first rotary cutter 7 is fixedly mounted on a rotary shaft 18 that is journalled to the front and rear walls 9*a* and 9*b* of the support structure 9 and is so positioned that an uppermost outer peripheral portion of the first rotary cutter 7 protrude upwardly through a slit 50, defined in the support table 5, so as to plunge from below into the flat cardboard plate 2 to a depth slightly greater than one half of the thickness of the flat cardboard plate 2. The lowermost outer periphery of the first rotary cutter 7 and the uppermost outer periphery of the second rotary cutter 8 are held at different levels, respectively, so that when viewing in a direction conforming to the direction F of feed of the flat cardboard plate 2, the first and second rotary cutters 7 and 8 can have an apparent overlap 70 of a slight width in a direction heightwise of the support structure 9.

In practice, however, the rotary shafts 17 and 18 are so positioned and so displaced leftwards and rightwards relative to each other that the first and second rotary cutters 7 and 8 can be supported with their axes of rotation offset relative to each other in the leftward and rightward direction X. More specifically, the axis of rotation of the second rotary cutter 8 is positioned a slight distance leftwards of the axis of rotation of the first rotary cutter 7, that is, on a leading side with respect to the direction of movement XL of the support structure 9 towards the advanced position during an cutting operation. Accordingly, the lowermost and uppermost outer periphery of the first and second rotary cutters 7 and 8, respectively, do not interfere with each other.

A drive motor 19 for driving the first and second rotary cutters 7 and 8 is fixedly mounted atop the support structure 9. This drive motor 19 is drivingly coupled with the rotary shaft 17 for the first rotary cutter 7 through a sprocket 20, a toothed endless belt 21 and a sprocket 22 so that the drive of the drive motor 19 can be transmitted to the first rotary cutter 17. The rotary shaft 17 for the first rotary cutter 7 is in turn drivingly coupled with the rotary shaft 18 for the second rotary cutter 8 through gears 23 and 24, a sprocket 25, a toothed endless belt 26 and a sprocket 27 so that the drive of the rotary shaft 17 can be transmitted to the rotary shaft 18. A drive transmission mechanism including these sprockets 20, 22, 25 and 27, the toothed endless belts 21 and 26 and the gears 23 and 24 is enclosed by a shroud 31 mounted on the support structure 9.

As best shown in FIG. 2, the support structure 9 is movably mounted on spaced apart guide rails 60, fixedly mounted on the guide bench 6, through pairs of spaced apart guide bodies 28, each pair of guide bodies 28 being secured to one side of the support structure 9. Thus, it will readily be seen that the support structure 9 can move on and along the guide bench 6 in the leftward and rightward direction X between the rest and advanced positions.

A cable bearer 29 having one end connected with a lower portion of the support structure 9 is disposed above the guide bench 6. A power supply cable for supplying an electric power to the drive motor 19 atop the support structure 9 for driving the first and second rotary cutters 7 and 8 and any other control wiring are connected with an external control console (not shown) through this cable bearer 29 without disturbing the movement of the support structure 9 between the rest and advanced positions.

A retainer mechanism 33 for retaining the flat cardboard plate 2 against the support table 5 to retain the flat cardboard plate 2 in position during the cutting operation is disposed above the support table 5. This retainer mechanism 33 includes cylinders 35 each having a respective piston rod 35*a* movable between projected and retracted positions, a retainer bar 36 having its opposite ends connected with free ends of the respective piston rods 35*a*, and guide members 34 for guiding movement of the retainer bar 36 in a direction perpendicular to the support table 5. The cylinders 35 are fixedly mounted on the support table 5 at respective locations adjacent opposite side edges of the flat cardboard plate 2 then resting on the support table 5, with the retainer bar 36 traversing above the flat cardboard plate 2.

The retainer mechanism 33 of the structure described above is so positioned and so configured that the retainer bar 36 when descended as a result of synchronized movement of the piston rods 35*a* towards the retracted position can be brought into contact with a portion of the flat cardboard plate 2 which is on one of opposite sides of the cutting line b (FIG. 3A) opposite to the leading end portion (which will subsequently become the corrugated cardboard block 3) of the flat cardboard plate 2 with respect to the direction F of feed of the flat cardboard plate 2 towards the advanced position. This retainer mechanism 33 is thus effective to retain the flat cardboard plate 2 immovable relative to the support table 5, resulting in that leading end portion of the flat cardboard plate 2 being cut stably and accurately.

A level adjusting mechanism 37 for adjusting the height of the support table 5 as measured above a support surface, for example, a floor where the cutting machine is installed is disposed below the support table 5. As shown in FIG. 2, this level adjusting mechanism 37 includes four ball nuts 38 fixedly carried by and positioned below four corner portions of the support table, vertically extending ball screws 39 each threadingly engaged in the corresponding ball nut 38, and a transmission mechanism 41 including a handle 40 for transmitting a rotational force of the handle 40 simultaneously to the ball screws 39. Thus, when the handle 40 is turned, the ball screws 39 can be turned in the same direction about their own longitudinal axes in unison with each other with the ball nuts 38 and, hence, the support table 5 consequently moved upwards or downwards depending on the direction of turn of the handle 40.

Figure 4A:
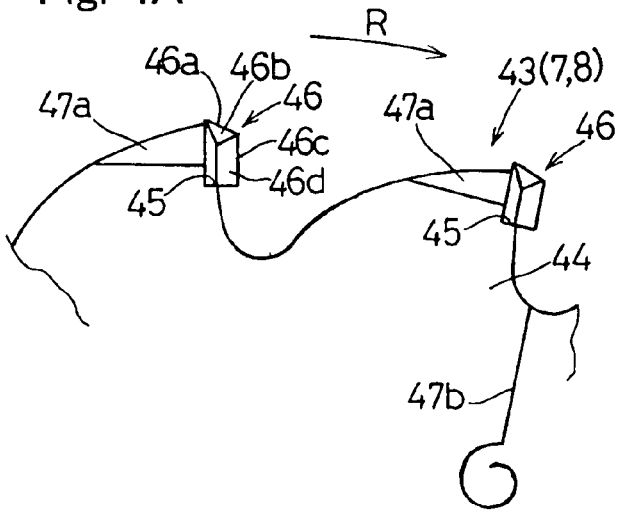
FIG. 4A is a fragmentary side view showing a portion of a circular saw used as a rotary cutting blade in the rotary cutting machine shown in FIG. 1.
Figure 4B:
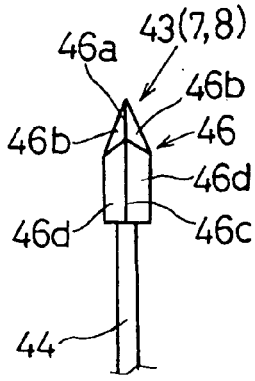
FIG. 4B is a fragmentary front elevational view of that portion of the circular saw shown in FIG. 4A.

In the illustrated embodiment, each of the first and second rotary cutters 7 and 8 is employed in the form of a circular chip saw 43 as best shown in FIGS. 4A and 4B. Referring now to FIGS. 4A and 4B, the circular chip saw 43 includes a disc body 44 having its outer periphery formed with a multiplicity of chip seats 45, and a cutting chip 46 fixed to each of the chip seats 45 and having a blade thickness greater than the thickness of the disc body 44. The cutting chip 46 is of a design including a first blade ridge 46*a* inclined downwardly with respect to the direction of rotation of the rotary cutter 7 or 8 shown by the arrow R so that a leading end of the first blade ridge 46*a* lies at a level lower than a trailing end thereof with respect to the direction R of rotation, and first slant faces 46*b* inclined radially upwardly so as to symmetrically converge at the first blade ridge 46*a*. This cutting chip 46 also includes a second blade ridge 46*c* extending from the leading end of the first blade ridge 46*a* in a direction generally radially inwardly of the disc body 44, and second slant faces 46*d* inclined rearwardly therefrom with respect to the direction R of rotation so as to symmetrically converge at the second blade ridge 46*c*. The first and second blade ridges 46*a* and 46*c* are so positioned as to align with a plane of the disc body 44 that lies intermediate of the thickness of the disc body 44 and, hence, are positioned intermediate of the thickness of the respective rotary cutter 7 or 8.

As shown in FIG. 4A, reference numeral 47*a* represents flanks each positioned on a trailing side of the corresponding cutting chip 46 with respect to the direction R of rotation, and reference numeral 47*b* represents a slit formed in the disc body 44 so as to extend radially inwardly from the tooth root for suppressing resonance.

Figure 5A:
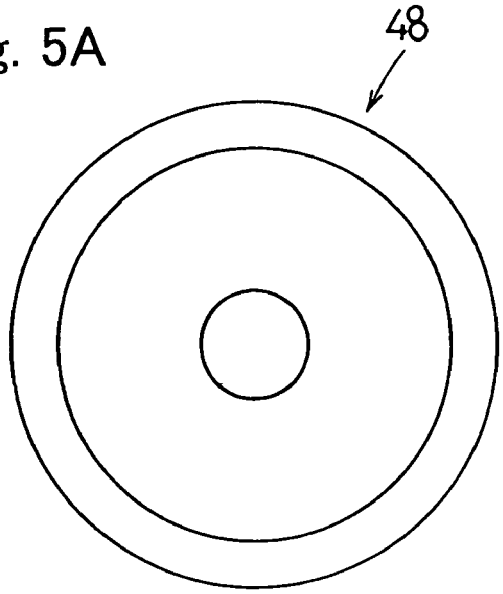
FIG. 5A is a side view showing a modified cutting blade that can be employed in the rotary cutting machine.
Figure 5B:
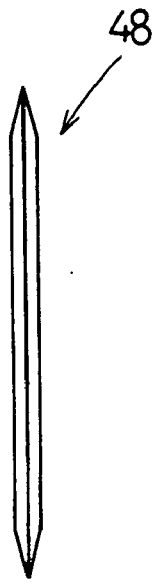
FIG. 5B is a front elevational view of the modified cutting blade shown in FIG. 5A.

Alternatively, any one of the first and second rotary cutters 7 and 8 may be in the form of a circular slitter knife 48 including a disc body having its outer periphery formed with a radially outwardly sharpened knife edge as shown in FIG. 5.

Hereinafter, the operation of the cutting machine according to the foregoing embodiment will be described. Prior to the cutting operation, the height of the support table 5 shown in FIG. 2 has to be adjusted by means of the level adjusting mechanism 37 so that upper and lower halves of the thickness of the flat cardboard plate 2 can be cut respectively by the first and second rotary cutters 7 and 8. After the height of the support table 5 has been so adjusted, the flat cardboard plate 2 resting on the support table 5 has to be fed towards a cutting position by means of a feed mechanism (not shown) a predetermined distance w corresponding to the width of the eventually obtained corrugated cardboard block 3. The retainer mechanism 33 is then activated to lower the retainer bar 36 to thereby press down to retain the flat cardboard plate 2 in position immovable relative to the support structure 9.

Thereafter, the first and second rotary cutters 7 and 8 are driven by the drive motor 19 on the support structure 9 in respective directions counter to each other, followed by activation of the drive mechanism 10 to move the support structure 9, then at the rest position as shown in FIG. 1, towards the advanced position in a direction shown by the arrow XL. At this time, the drive motor 19 is set to drive the first rotary cutter 7 for cutting the upper half of the flat cardboard plate 2 about the shaft 17 in such a direction that a leading portion of the first rotary cutter 7, with respect to the direction of movement XL, can plunge from above into the flat cardboard plate 2, that is, in a counterclockwise direction R1 as viewed in FIG. 1 and, on the other hand, to drive the second rotary cutter 8 for cutting the lower half of the flat cardboard plate 2 in such a direction that a leading portion of the first rotary cutter 8, with respect to the direction of movement XL, can plunge from below into the flat cardboard plate 2, that is, in a clockwise direction R2 as viewed therein.

Figure 6:
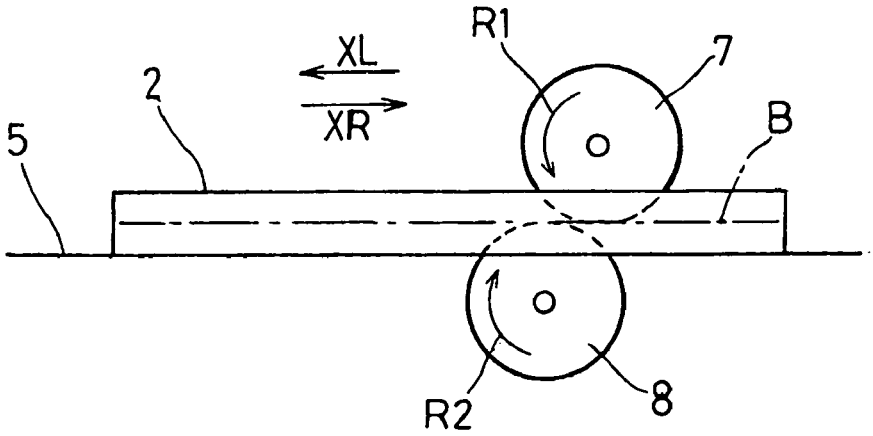
FIG. 6 is a schematic front elevational view showing a cutting operation performed by the rotary cutting machine with respect to the flat cardboard plate.

As the support structure 9 is moved towards the advanced position, the first and second rotary cutters 7 and 8 move along the cutting line b shown in FIG. 2 to separate the leading end portion of the flat cardboard plate 2 to thereby provide the corrugated cardboard block 3. FIG. 6 illustrates the relationship between the first and second rotary cutters 7 and 8 relative to the flat cardboard plate 2 being cut. Since the first rotary cutter 7 cuts the upper half of the thickness of the flat cardboard plate 2 and the second rotary cutter 6 cuts the lower half of the thickness of the flat cardboard plate 2, it will readily be seen that with no need to use rotary cutters of an increased diameter, the flat cardboard plate 2 having a relatively great thickness can be cut. Consequently, any possible lateral deformation of the cutter blade of each of the first and second rotary cutters 7 and 8 during the actual cutting operation can be minimized and, hence, the cutting accuracy, that is, the dimensional precision to cut the leading end portion of the flat cardboard plate 2 to a width equal to the distance w of intermittent feed of the flat cardboard plate 2 can be increased. Also, since any possible rocking motion of each of the first and second rotary cutters 7 and 8 is also minimized, the kerf, that is, the width of a portion of the flat cardboard plate 2 that is removed by cutting can advantageously be minimized. In particular, since in the practice of the illustrated embodiment of the present invention, each of the first and second rotary cutters 7 and 8 makes use of the circular chip saw 43 of the structure shown in FIGS. 4A and 4B, the kerf can be minimized.

Also, since as shown in FIG. 6, the boundary B in a cut section across the thickness of the flat cardboard plate 2 between a upper cut face exhibited by the first rotary cutter 7 and a lower cut face exhibited by the secondary rotary cutter 8 lies at a location substantially intermediate of the thickness of the flat cardboard plate 2, there is no possibility that burring which would otherwise brought about by the first and second rotary cutters 7 and 8 will not occur on front (or upper) and rear (or lower) sides of the flat cardboard plate 2 and, accordingly, the flat cardboard plate 2 can be beautifully cut. The boundary B referred to above has a width corresponding to the overlap 70 between the first and second rotary cutters 7 and 8 discussed hereinbefore.

After the leading end portion of the flat cardboard plate 2 has been cut to provide a single corrugated cardboard block 3, the drive motor 14 of the drive mechanism 10 shown in FIG. 1 is reversed to drive the support structure 9 in a direction, shown by the arrow XR, towards the rest position. During this return movement of the support structure 9, the first and second rotary cutters 7 and 8 move along a cut groove formed in the flat cardboard plate 2. Upon return of the support structure 9 back to the rest position, the retainer bar 36 is elevated to release the flat cardboard plate 2 so that the flat cardboard plate 2 can be subsequently fed the distance w (FIG. 2) toward the cutting position in readiness for the next succeeding cycle of cutting.

Thereafter, to provide a desired number of the corrugated cardboard blocks 3 shown in FIG. 3A, intermittent feed of the flat cardboard plate 2 and intermittent drive of the support structure 9 towards the advanced position are alternately performed cyclically.

Where the flat cardboard plate 2 of a different thickness is desired to be cut, the height of the support table 5 has to be adjusted by means of the level adjusting mechanism 37 so that the boundary B in the cut section across the thickness of the flat cardboard plate 2 between the upper cut face exhibited by the first rotary cutter 7 and the lower cut face exhibited by the secondary rotary cutter 8 lies at a location substantially intermediate of the thickness of the flat cardboard plate 2.

As hereinabove described, the level adjusting mechanism 37 is effective to allow the cutting machine embodying the present invention to accommodate different thickness of the flat cardboard plates 2, since with the level adjusting mechanism 37 the boundary B in the cut section across the thickness of the flat cardboard plate 2 can be set to the location substantially intermediate of the thickness of the flat cardboard plate 2. Therefore, even though each of the first and second rotary cutters 7 and 8 may have a relatively small diameter, the flat cardboard plates having a varying thickness can be satisfactorily and beautifully cut.

It is to be noted that although in the foregoing embodiment, the flat cardboard plate 2 has been described as cut by the first and second rotary cutters 7 and 8 only when the support structure 9 is moved in the direction XL from the rest position towards the advanced position, the cutting efficiency will be increased if cutting is equally performed during the return movement of the support structure 9 in the direction LR from the advanced position towards the rest position.

Figure 7:
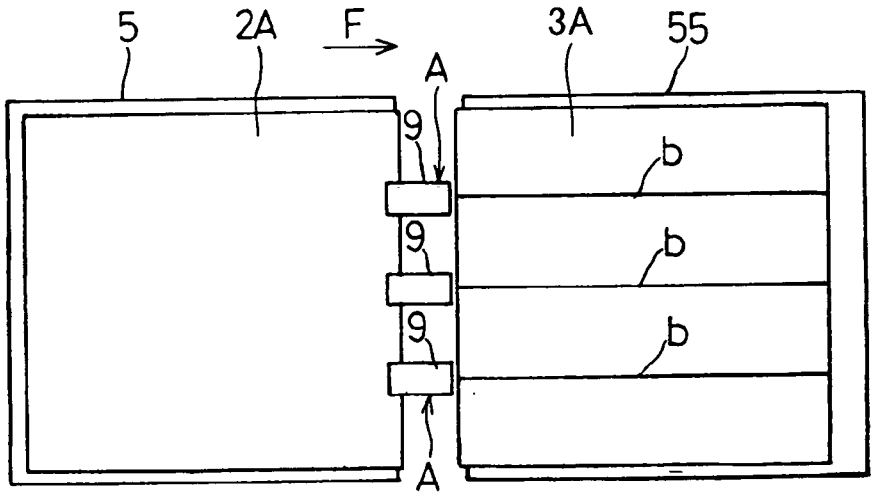
FIG. 7 is a plan view showing the rotary cutting machine according to a second preferred embodiment of the present invention.
Figure 8:
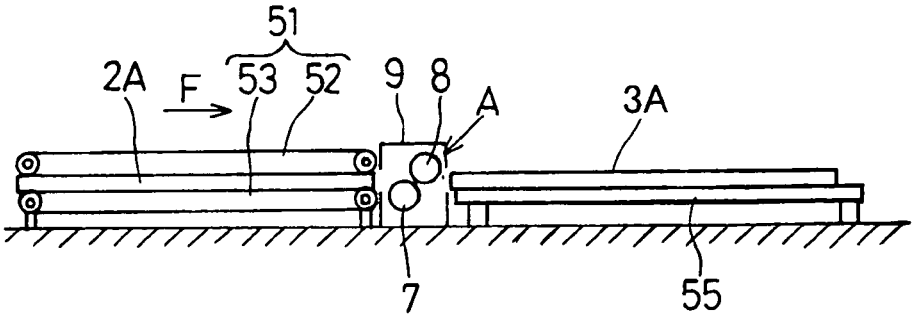
FIG. 8 is a schematic side view of the rotary cutting machine shown in FIG. 7.

FIGS. 7 and 8 illustrate, in a plan view and a side view, respectively, a cutting apparatus according to a second preferred embodiment of the present invention. In this embodiment of FIGS. 7 and 8, a plurality of identical cutting machines A of the structure shown in and described with reference to FIGS. 1 to 4B are utilized to form a shearing apparatus for cutting the flat cardboard plate 2A in a direction longitudinally thereof to provide a plurality of corrugated cardboard members 3A. In this embodiment, however, the first and second rotary cutters 7 and 8 are not moved, but the flat cardboard plate 2A is moved horizontally. In other words, in the embodiment shown in FIGS. 7 and 8, the support structures 9 each supporting the first and second rotary cutters 7 and 8 are fixed in position and, instead, a feed mechanism 51 for horizontally moving the flat cardboard plate 2A in the direction F of feed is disposed rearwardly of the support structures 9.

The feed mechanism 51 includes, as best shown in FIG. 8, a pair of endless bent conveyors 52 and 53 positioned one above the other for sandwiching the flat cardboard plate 2A for feeding the latter horizontally in the direction F of feed. A receiving table 55 for receiving the corrugated cardboard members 3A cut from the flat cardboard plate 2A is disposed forwardly of the support structures 9 of the respective cutting machines A, that is, on one side of a group of the cutting machines A opposite to the support table 5. In this structure, the flat cardboard plate 2A is, while sandwiched between the endless belt conveyors 52 and 53 fed in the direction F of feed towards the first and second rotary cutters 7 and 8 and is then cut by the first and second rotary cutters 7 and 8 along the cutting lines b, in a manner substantially similar to the cutting operation described in connection with the previous embodiment, to thereby provide the corrugated cardboard members 3A that are received on the receiving table 55. Even the second embodiment of the present invention brings about effects similar to those afforded by the first embodiment.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, although the core sheet 1*a* of each of the laminated cardboards 1 forming a part of the flat cardboard plate 2 or 2A has been described and shown as corrugated, it may not be always limited thereto and may be of a kind having a multiplicity of generally trapezoidally sectioned through-holes.

Also, the flat cardboard plate 2 or 2A may not be limited to the laminated product of corrugated cardboards each including the corrugated core sheet 1*a* sandwiched between the liner sheets 1*b* and may be of a honeycomb structure in which a multiplicity of polygonal meshes are adjoining one another.

Accordingly, such changes and modifications are, unless they depart from the scope of the present invention as delivered from the claims annexed hereto, to be construed as included therein.

What is claimed is:

1. A cutting machine for cutting a flat cardboard plate having a cardboard, said cutting machine comprising:

a first rotary cutter for cutting an upper portion of the flat cardboard plate;

a second rotary cutter rotatable in a direction counter to a direction of rotation of the first rotary cutter for cutting a lower portion of the flat cardboard plate;

a drive mechanism for driving the first and second rotary cutters relative to the flat cardboard plate along a single cutting line to cut the flat cardboard plate along such cutting line;

a support table for supporting from below the flat cardboard plate, and a level adjusting mechanism for adjusting a relative position between the support table and the first and second rotary cutters in a direction up and down according to a thickness of the flat cardboard plate to be cut and for setting a boundary between respective depth of cutting by the first and second rotary cutters to a value substantially equal to one half of a thickness of the flat cardboard plate; and a retaining mechanism for pressing a portion of the flat cardboard plate on a trailing side of the cutting line with respect to a direction of feed of the flat cardboard plate against the support table by moving a retainer bar only in a vertical direction to retain the flat cardboard plate immovable during a cutting operation.

2. The cutting machine for cutting the flat cardboard plate as claimed in claim 1, wherein each of the first and second rotary cutters rotates in such a direction as to permit a leading portion of the respective rotary cutter, with respect to a direction of movement relative to the flat cardboard plate, to plunge into the flat cardboard plate.

3. The cutting machine for cutting the flat cardboard plate as claimed in claim 1, wherein the level adjusting mechanism is operable to selectively elevate and lower the support table.

4. The cutting machine for cutting the flat cardboard plate as claimed in claim 1, further comprising a support structure for rotatably supporting the first and second rotary cutters and wherein the drive mechanism is operable to move the support structure relative to the cardboard plate.

5. The cutting machine as claimed in claim 1, wherein the flat cardboard plate is maintained in a stationary position when the drive mechanism drives the first and second rotary cutters relative to the flat cardboard plate along the single cutting line.

6. A cutting machine comprising:

a first rotary cutter operable to cut an upper portion of an article;

a second rotary cutter which rotates in a direction counter to a direction of rotation of the first rotary cutter and operable to cut a lower portion of the article;

a drive mechanism operable to drive the first and second rotary cutters relative to the article along a single cutting line to cut the article along such cutting line;

a support table operable to support from below the article, and a level adjusting mechanism operable to adjust a relative position between the support table and the first and second rotary cutters in a vertical direction according to a thickness of the article to be cut; and a retaining mechanism operable to press a portion of the article on a trailing side of the cutting line with respect to a direction of feed of the article against the support table to retain the article immovable during a cutting operation, wherein the adjusting mechanism is further operable to set a boundary between respective depth of cutting by the first and second rotary cutters to a value substantially equal to one half of a thickness of the article.

7. The cutting machine as claimed in claim 6, wherein each of the first and second rotary cutters rotates in such a direction as to permit a leading portion of the respective rotary cutter, with respect to a direction of movement relative to the article, to plunge into the article.

8. The cutting machine as claimed in claim 6, wherein the level adjusting mechanism is operable to selectively elevate and lower the support table.

9. The cutting machine as claimed in claim 6, wherein the article is maintained in a stationary position when the drive mechanism drives the first and second rotary cutters relative to the article along the single cutting line.

10. A cutting machine comprising:

a first rotary cutter operable to cut an upper portion of an article;

a second rotary cutter which rotates in a direction counter to a direction of rotation of the first rotary cutter and operable to cut a lower portion of the article;

a drive mechanism operable to drive the first and second rotary cutters in a back and forth motion along a single cutting line; and a support table operable to support from below the article, and a level adjusting mechanism operable to adjust a relative position between the support table and the first and second rotary cutters in a vertical direction according to a thickness of the article to be cut, wherein the adjusting mechanism is further operable to set a boundary between respective depth of cutting by the first and second rotary cutters to a value substantially equal to one half of a thickness of the article.

11. The cutting machine as claimed in claim 10, wherein each of the first and second rotary cutters rotates in such a direction as to permit a leading portion of the respective rotary cutter, with respect to a direction of movement relative to the article, to plunge into the article.

12. The cutting machine as claimed in claim 10, wherein the level adjusting mechanism is operable to selectively elevate and lower the support table.

13. The cutting machine as claimed in claim 10, further comprising a retaining mechanism operable to press a portion of the article on a trailing side of the cutting line with respect to a direction of feed of the article against the support table to retain the article immovable during a cutting operation.

14. The cutting machine as claimed in claim 10, wherein the article is maintained in a stationary position when the drive mechanism drives the first and second rotary cutters in the lateral direction relative to the article along the single cutting line.

* * * * *